United States Patent [19]

Farmer

[11] 4,110,204

[45] Aug. 29, 1978

[54] PROCESS FOR REMOVING POLONIUM FROM NATURAL GAS CONDENSATES CONTAINING THE SAME

[75] Inventor: Thomas Henry Farmer, Hatfield, England

[73] Assignee: Carless, Capel & Leonard Limited, London, England

[21] Appl. No.: 772,958

[22] Filed: Feb. 28, 1977

[30] Foreign Application Priority Data

Mar. 2, 1976 [GB] United Kingdom ..... 8347/76

[51] Int. Cl.[2] ..... C10G 25/02

[52] U.S. Cl. ..... 208/251 R; 423/7

[58] Field of Search ..... 208/251 R; 423/7

[56] References Cited

U.S. PATENT DOCUMENTS

| | | | |
|---|---|---|---|
| 2,367,803 | 1/1945 | Schindler | 208/251 |
| 2,925,431 | 2/1960 | Choppin et al. | 423/7 |
| 3,773,899 | 11/1973 | George et al. | 423/7 |
| 3,799,870 | 3/1974 | Heilweil | 208/251 R |

FOREIGN PATENT DOCUMENTS

| | | | |
|---|---|---|---|
| 769,121 | 2/1957 | United Kingdom | 423/7 |

*Primary Examiner*—Delbert E. Gantz
*Assistant Examiner*—James W. Hellwege
*Attorney, Agent, or Firm*—Young & Thompson

[57] ABSTRACT

A process for removing polonium from hydrocarbons which process comprises contacting fluid polonium containing hydrocarbons with an ion exchange resin, having a dry surface area of at least 1 $m^2/g$ and containing exchange groups selected from the group consisting of acidic and strongly basic exchange groups.

The ion exchange resins are preferably macroreticular resins. Suitable hydrocarbons for treatment are natural gas condensates.

8 Claims, No Drawings

PROCESS FOR REMOVING POLONIUM FROM NATURAL GAS CONDENSATES CONTAINING THE SAME

FIELD OF THE INVENTION

The present invention relates to a method of removing polonium from hydrocarbons and more particularly from polonium containing natural gas condensates and distilled hydrocarbons.

It has long been known that in common with other fossil fuels crude oil and natural gas contain radioactive elements. In some fields the gas and oil contain abnormal concentrations of radioelements and their daughter elements and the presence of radon, helium, argon, radium, uranium and thorium has been reported. More recently, it has been discovered that in certain parts of the world liquid hydrocarbons associated with natural gas (often termed "gas condensate" or "natural gas liquids") contain polonium 210 in low concentration. As this isotope appears not to be in equilibrium with other members of the radioactive series it is concluded that the polonium has in some way been preferentially extracted by the hydrocarbons and is probably present as an inorganic or an organic compound. The levels of radioactivity are usually low but can cause problems during refining operations particularly when the polonium becomes concentrated at any stage. It is therefore desirable to remove or reduce the polonium content of the condensate prior to refining.

BRIEF DESCRIPTION

The present invention provides a process for removing polonium from hydrocarbons which process comprises contacting a hydrocarbon, or a mixture thereof, containing polonium with an ion exchange resin having a dry surface area of not less than 1 $m^2/g$ and containing acidic or strongly basic exchange groups or a mixture thereof.

It is preferred that the ion exchange resin be strongly acidic. The dry surface area of the ion exchange resin is preferably greater than 5 $m^2/g$.

Dry surface areas of ion exchange resins are to be measured by the B.E.T. method; i.e. by determining the quantity of nitrogen required to form a monomolecular layer at a temperature of −197° C.

It is preferred that the ion exchange resin be of the macroreticular type and particularly one designed for use in non-aqueous systems. Macroreticular resins have a rigid, porous structure giving a large surface area (e.g. 30 to 120 $m^2/g$). The porosity of macroreticular resins is due to larger pores than those of gel type resins and these pores do not disappear when the resin is dehydrated. The average pore diameter may be about 200Å but even an average of 1300Å is not unusual.

DETAILED DESCRIPTION

The strongly acidic ion exchange resins are preferably sulphonic acid resins.

Examples of sulphonic macroreticular resins are Amberlyst 15, Amberlite 200 and Amberlite 252. These resins are sulphonated styrene-divinylbenzene copolymers possessing particularly rigid, porous structures. Further details of these resins are given hereafter.

Weakly acidic resins containing carboxylic groups may be used. Resins may contain a mixture of sulphonic and carboxylic groups.

Suitable strongly basic ion exchange resins include Amberlyst 29 and Amberlyst 26 which contain dimethylhydroxyethylamino groups and trimethylamino groups respectively. Weakly basic ion exchange resins, i.e. those not containing quaternary amino groups but containing, for instance, dimethylamino groups do not reduce the polonium content appreciably.

Further examples of suitable resins are Lewatit macroreticular (sulphonic acid/strong base), Diaion porous (sulphonic acid/trimethylamino/dimethylhydroxyethylamino), IMAC porous (sulphonic acid/trimethylamino/dimethylhydroxyethylamino), Dowex macroporous (sulphonic acid and trimethylbenzylammonium, Lewatit macroreticular (carboxylic) and Asmit porous (trimethylamino).

Hydrocarbons suitable for treatment by the method of the invention are typically mixtures of hydrocarbons boiling between 25° C. and 330° C. but may contain higher boiling materials, e.g. boiling at up to 400° C. They are however free from very high boiling components when tested by the Engler distillation procedure. The presence in the polonium containing hydrocarbon of solids or polymerisable materials which could deposit insoluble polymers or cause a violent reaction on the column are obviously undesirable as are high concentrations of nitrogenous bases or metal salts whose cations would cover the acidic sites on the resin when an acidic resin is used. The hydrocarbon is preferably a natural gas condensate.

With porous resins such as Amberlyst 15 the hydrocarbon may be in the gaseous phase so that gaseous hydrocarbons or vapourised liquids may be treated. However, in the latter case the polonium tends to distribute itself between the vapour phase and the residue making this approach unattractive.

Regeneration of the resin is effected in the conventional way, acidic resins being regenerated, by the use of dilute mineral acids after the removal of hydrocarbon with a water miscible solvent such as iso-propanol. The bed may be used at any temperature within the stability range of the resin, e.g. up to 150° C., but it is preferred to perform the treatment at ambient temperature in order to avoid the necessity of using pressure resistant equipment. The efficiency of polonium removal varies with the flow rate but rates of 5 to 10 column volumes per hour result in the removal of a high proportion of the polonium. This procedure is also useful for removing traces of other metals such as mercury which are present in some condensates and can contribute to corrosion or other problems.

The polonium is found to remain on the resin during regeneration so that radioactive column washings are not produced.

In a continuous method according to the invention, three columns or more may be used in a cyclic manner, the hydrocarbon flowing through two columns for all or most of the time whilst a third column is being regenerated. In a system of three columns A, B and C, A and C may be used as separate main columns, each run alternatively in combination with column B which acts as a guard. When B is exhausted, either A or C may be run separately whilst B is regenerated. Alternatively, A, B and C may be cycled through the roles of main column, guard column and regenerated column so that two columns are always being used for extraction.

The periods between regeneration may be extended by reducing the concentrations of trace quantities of salts of calcium, magnesium and other metals, for example by washing with water, prior to the passage of the hydrocarbon through the ion exchange column.

In such cases the capacity of the column appears to be gradually reduced by the formation of low molecular weight polymers which are deposited on the resin, and regeneration may be effected by the passage of the organic solvent alone. Eventually, after many regenerations of this type, an acid cycle is required. When the acid cycle is not used for regeneration the organic solvent need not necessarily be water miscible. Xylene is an example of such a solvent.

The invention includes hydrocarbons purified by removal of polonium by the method of the invention.

The invention will now be illustrated by Examples.

EXAMPLE 1

A bed of the acid form of Amberlyst 15 sulphonic acid ion exchange resin 12.5 × 4 cm was prepared and condensate containing polonium 210 and exhibiting an activity of 0.4 pCi/ml was passed through at 5 column volumes per hour at 20° C.

After 515 column volumes of condensate had passed through the bed it was regenerated by the serial passage of one column volume each of iso-propanol, water, 5% sulphuric acid and then water until the effluent possessed a pH of 5. The column was finally dehydrated with one column volume of iso-propanol before commencing the second cycle with condensate.

Table I summarizes the results obtained:

TABLE I

| FLOW RATE COLUMN VOLUMES/HR | SAMPLE TAKEN AFTER | % RADIO-ACTIVITY REMOVED |
|---|---|---|
| 5 | 2 column volumes | 97 |
| 5 | 10 | 95 |
| 5 | 33 | 93 |
| 5 | 67 | 88 |
| 5 | 220 | 64 |
| 5 | 400 | 76 |
| 5 | 515 | 56 |
| COLUMN REGENERATED | | |
| 5 | 37 | 96 |
| 5 | 200 | 91 |
| 10 | 207 | 82 |
| 10 | 248 | 83 |

EXAMPLE 2

Example 1 was repeated but a bed of Amberlyst 29 in which the active group is dimethylhydroxyethylamino was substituted for the Amberlyst 15. The results were as follows:

TABLE II

| FLOW RATE COLUMN VOLUMES/HR | SAMPLE TAKEN AFTER | % RADIO-ACTIVITY REMOVED |
|---|---|---|
| 5 | 2 column volumes | 93 |
| 5 | 95 | 58 |
| 5 | 135 | 58 |
| 5 | 220 | 59 |

Technical details of the resins referred to above are as follows:

| | |
|---|---|
| Amberlyst 15 | |
| Appearance | Hard, grey spherical granules |
| Bulk Density g/l | 595 |
| Swelling on Saturation in: | |
| hexane | 12% |
| ethyl acetate | 35% |
| water | 66% |
| Hydrogen Ion Concentration (meq/g dry) | 4.9 |
| Surface Area $m^2/g$ | 40 to 50 |
| Porosity ml pore/ml bead | .30 to .35 |
| Average Pore Diameter A | 200 to 600 |
| Amberlite 200 and 252 | |
| pH range | 0–14 |
| Maximum operating temperature | 300° F |
| Total exchange capacity (meq/ml wet) | 1.75 |
| % Reversible swelling based on complete conversion | 3 to 5 |
| Amberlyst 29 | |
| Appearance | Hard, spherical, light tan, water saturated beads |
| Swelling on Saturation in: | |
| isooctane | 0% |
| ethyl acetate | 5% |
| water | 15% |
| Surface Area $m^2/g$ | 40 to 50 |
| Average Pore Diameter A | 200 to 600 |

EXAMPLE 3

Condensate was water washed with two 5% v/v aliquots of water for two minute periods, allowed to settle under gravity for 18 hours and the hydrocarbon decanted. The water washing did not reduce the level of activity in the condensate.

A bed of the acid form of Amberlyst 15 sulphonic acid ion exchange resin 12.1 × 4 cm was prepared and the washed condensate was passed through at 10 column volumes per hour at 20° C. After 1510 column volumes had passed through, the column was regenerated as in Example 1 and a second cycle commenced.

Table III summarizes the results obtained:

TABLE III

| FLOW RATE COLUMN VOLUMES/HR | SAMPLE TAKEN AFTER | % RADIO-ACTIVITY REMOVED |
|---|---|---|
| 10 | 450 column volumes | 93 |
| 10 | 950 | 86 |
| 10 | 1510 | 65 |
| COLUMN REGENERATED | | |
| 10 | 425 | 97 |

Comparisons of Example 3 with Examples 1 and 2 shows that water washing the condensate prior to passing it through the ion exchange column gives a substantial increase in the amount of condensate which can be treated before regeneration becomes necessary.

EXAMPLE 4

A pilot plant trial was performed by packing a cylindrical vessel 9 inches in diameter with 28 lb. Amberlyst 15 sulphonic acid resin. The feed was metered into the vessel at a controlled rate and passed through a distributor positioned a few inches above the resin surface. Samples of effluent were taken periodically and the point at which only 80% activity removal occurred was determined. This corresponded approximately to an overall activity removal of 90% to that point. Several runs were conducted, the bed being regenerated by the acid cycle using either methanol or iso-propanol as the water miscible solvent. The results are summarized in Table IV.

TABLE IV

| Run No | Flow Rate Column Volumes /hr | Bed regenerated with | Feedstock average activity pCi/ml | Capacity to 80% removal column volumes |
|---|---|---|---|---|
| 4/1 | 10 | | 0.6 | 2,250* |
| 4/2 | 10 | Methanol, sulphuric acid, water | 0.5 | 1,100 |
| 4/3 | 10 | Iso-propanol, sulphuric acid | 0.5 | 1,000 |
| 4/4 | 12.5 | Iso-propanol, sulphuric acid | 0.4 | 900 |
| 4/5 | 10 | Iso-propanol, sulphuric acid | 0.3 | 500 |

*For run 4/1 the resin was unswollen and occupied a volume equivalent to 5 gallons. During regeneration the resin swelled and runs 4/2 to 4/5 were conducted with a bed approximately 7.5 gallons in volume.

EXAMPLE 5

A similar bed to that used in Example 4 was prepared using 32 lb. Amberlyst 15 sulphonic acid resin which was packed in water and then dehydrated by passing through 2 column volumes of iso-propanol to yield a bed 8.6 gallons in volume. The results are summarized in Table V.

TABLE V

| Run No | Flow Rate Column Volumes /hr. | Bed regenerated with | Feedstock activity | Capacity to 80% activity removal |
|---|---|---|---|---|
| 5/1 | 16 | — | 0.4 | 750 |
| 5/2 | 10 | Iso-propanol | 0.5 | 1,600 |
| 5/3 | 10 | Iso-propanol | 0.5 | 1,600 |
| 5/4 | 8 | Iso-propanol | 0.4 | 1,200 |

EXAMPLE 6

Two beds, each containing 32 lb. Amberlyst 15 resin, were prepared as in Example 5 and connected in series. Condensate possessing an activity of 0.6 pCi/ml was passed through both beds at a rate equivalent to 5 column volumes per bed. The 80% activity removal point was obtained after 3,700 single column volumes of condensate had passed through the system.

EXAMPLE 7

The first of the two beds employed in Example 6 was regenerated by the passage of two column volumes of iso-propanol during the course of one hour. A number of trials was performed at a flow rate of 10 column volumes per hour, regenerations being conducted with either iso-propanol, methanol or methanol, sulphuric acid, water. The results are summarized in Table VI.

TABLE VI

| Run No | Flow Rate Column Volumes /hr | Bed regenerated with | Feedstock activity | Capacity to 80% activity removal |
|---|---|---|---|---|
| 7/1 | 10 | Iso-propanol | 0.2 | 1,630 |
| 7/2 | 10 | Methanol | 0.5 | 1,020 |
| 7/3 | 10 | Methanol | 0.3 | 810 |
| 7/4 | 10 | Iso-propanol | 0.2 | 710 |
| 7/5 | 10 | Methanol, sulphuric acid, water | 0.3 | 1,510 |

I claim:

1. A process for removing polonium from natural gas condensates which process comprises contacting fluid polonium containing natural gas condensates with an ion exchange resin having a dry surface area of at least 1 $m^2/g$ and containing exchange groups selected from the group consisting of acidic and strongly basic exchange groups.

2. A process as claimed in claim 1 wherein the ion exchange resin has a dry surface area of greater than 5 $m^2/g$.

3. A process as claimed in claim 2 wherein the ion exchange resin is a macroreticular ion exchange resin.

4. A process as claimed in claim 3 wherein the ion exchange resin is a strongly acidic resin.

5. A process as claimed in claim 4 wherein the strongly acidic ion exchange resin is a sulphonic acid ion exchange resin.

6. A process as claimed in claim 3 wherein the macroreticular ion exchange resin contains exchange groups selected from the group consisting of dimethylhydroxyethylamino and trimethylamino groups.

7. A process as claimed in claim 1 wherein the natural gas condensate is washed with water to remove metal salts prior to contact with the ion exchange resin.

8. A process as claimed in claim 1 which process comprises passing a natural gas condensate through a column containing a macroreticular ion exchange resin having ion exchange groups selected from the group consisting of sulphonic acid, dimethylhydroxyethylamino and trimethylamino groups, at a rate of 5 to 10 column volumes per hour.

* * * * *